United States Patent [19]

Izquierdo

[11] Patent Number: 4,803,745

[45] Date of Patent: Feb. 14, 1989

[54] SURVIVAL KNIFE SHEATH

[76] Inventor: Agustin Izquierdo, Bolivia, 1-1, Toledo, Spain

[21] Appl. No.: 66,197

[22] Filed: Jun. 25, 1987

[51] Int. Cl.[4] ..... B25F 1/00

[52] U.S. Cl. ..... 7/170; 7/158; 30/151; 206/317; 224/226; 224/240; 42/1.15

[58] Field of Search ..... 7/106, 158, 165, 170; 30/151; 42/1.15; 206/579, 317; 222/145, 386.5; 224/222, 226, 240

[56] References Cited

U.S. PATENT DOCUMENTS

| | | | |
|---|---|---|---|
| 3,385,163 | 5/1968 | Kotikov | 42/1.15 |
| 3,708,902 | 1/1973 | Foster et al. | 42/1.15 |
| 3,760,438 | 9/1973 | White | 7/158 |
| 3,855,710 | 12/1974 | Hunden | 33/295 |
| 4,266,357 | 5/1981 | Greenleaf | 42/1.15 |
| 4,303,187 | 12/1981 | Berman | 224/222 |
| 4,442,559 | 4/1984 | Collins | 7/158 |

FOREIGN PATENT DOCUMENTS

| | | | |
|---|---|---|---|
| 1205761 | 11/1965 | Fed. Rep. of Germany | 7/170 |

*Primary Examiner*—James G. Smith

*Attorney, Agent, or Firm*—Fleit, Jacobson, Cohn & Price

[57] ABSTRACT

A knife sheath is provided including a rear side defining an upwardly opening receptacle portion for downwardly receiving therein the blade of a survival knife and a front side defining a pair of side-by-side upwardly opening compartments with one of the compartments having a plurality of aerial flares stored therein and the other compartment defining an aerial flare supporting compartment in which the base end of one of the aerial flares may be removably retentatively supported. The knife sheath defines a firing pin bore disposed immediately beneath and opening upward into the aforementioned other compartment and containing an upwardly spring biased firing pin therein for impact with a center primer portion of the base end of aerial flare retained in position thereabove. The sheath also includes an exteriorly slidably mounted trigger member operably connected to firing pin through a slot formed in the sheath and upon which downward manual digital pressure may be applied to downwardly retract the firing pin from an associated aeral flare for subsequent release and impact engagement with the flare primer.

10 Claims, 2 Drawing Sheets

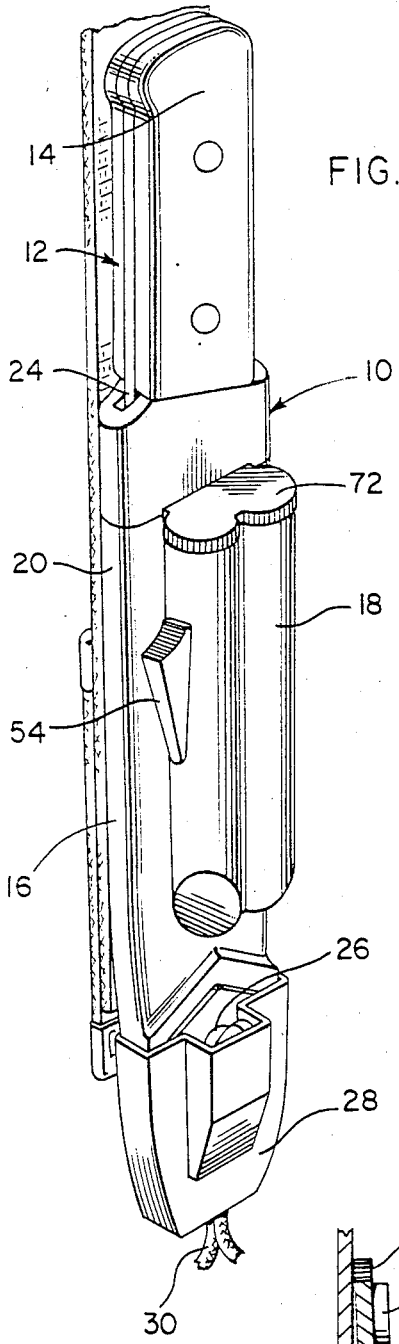
FIG. 1
FIG. 2
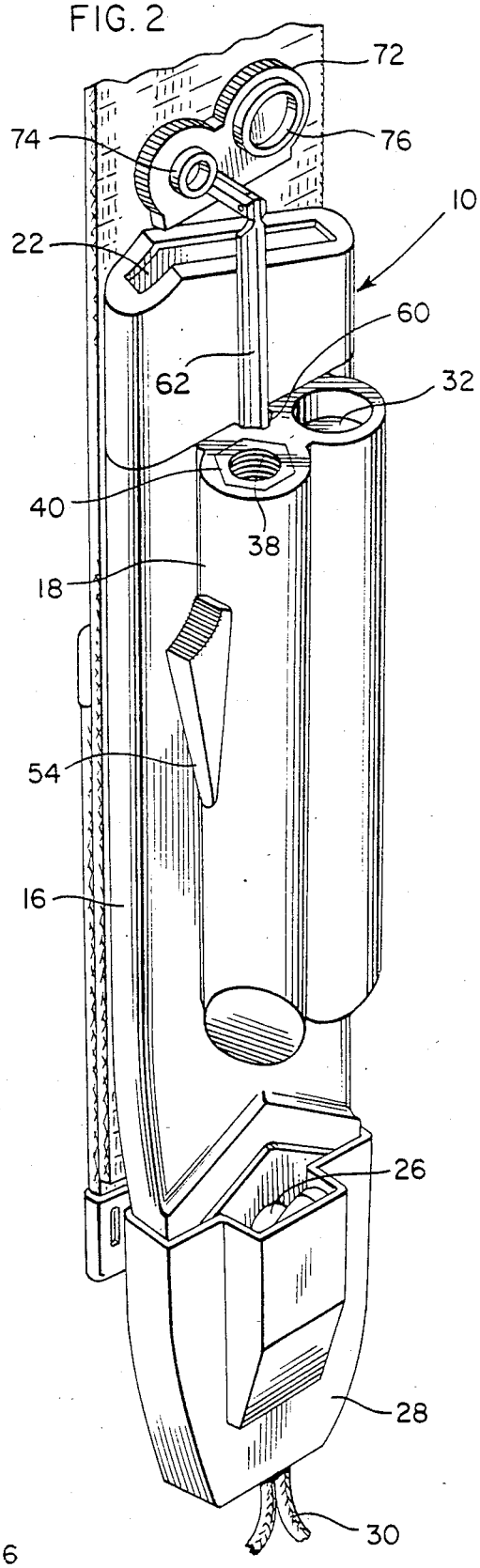
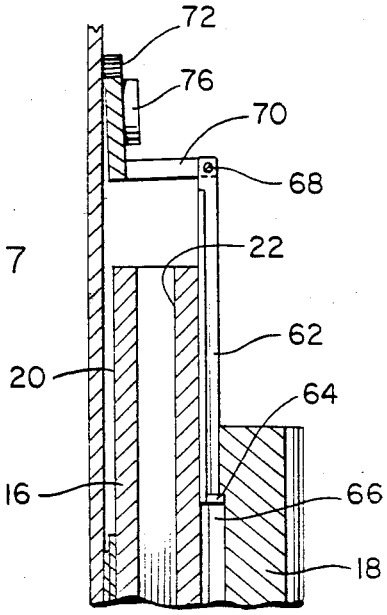
FIG. 7

FIG. 3
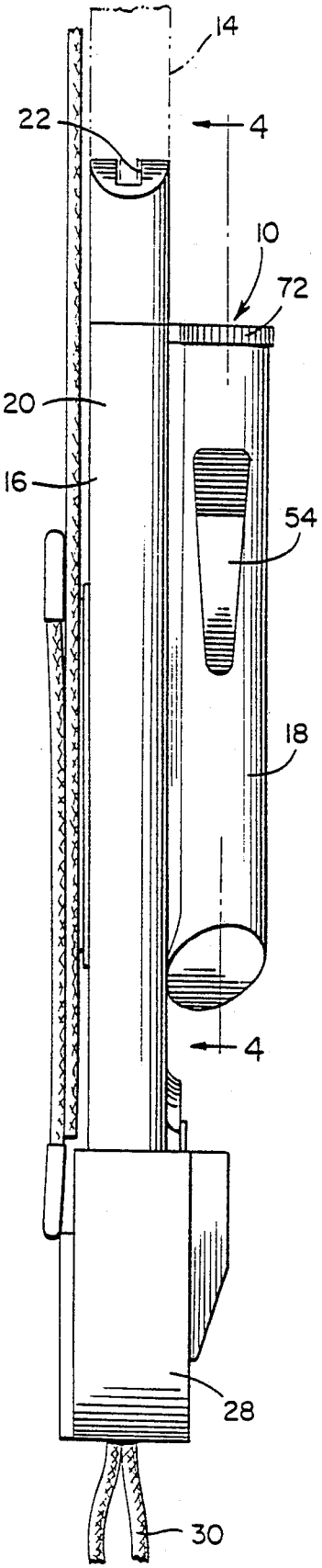
FIG. 4
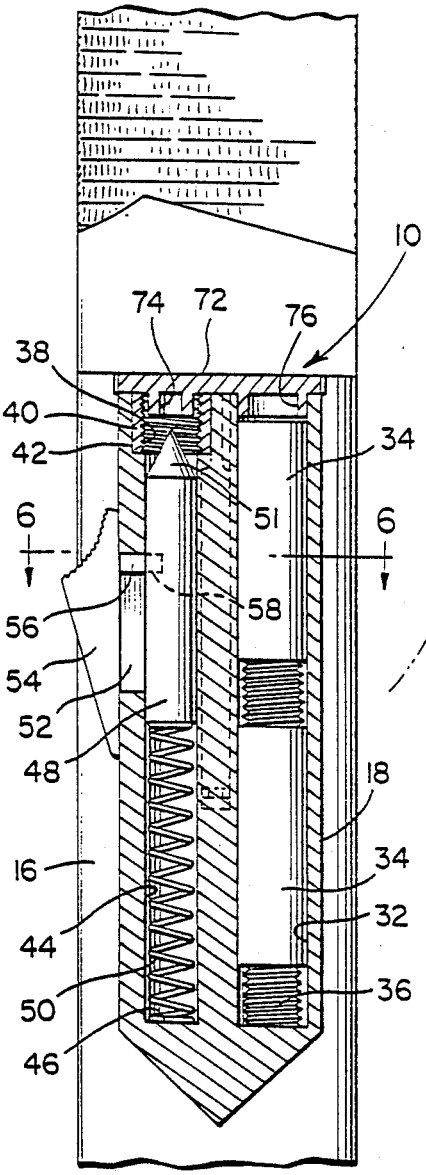
FIG. 5
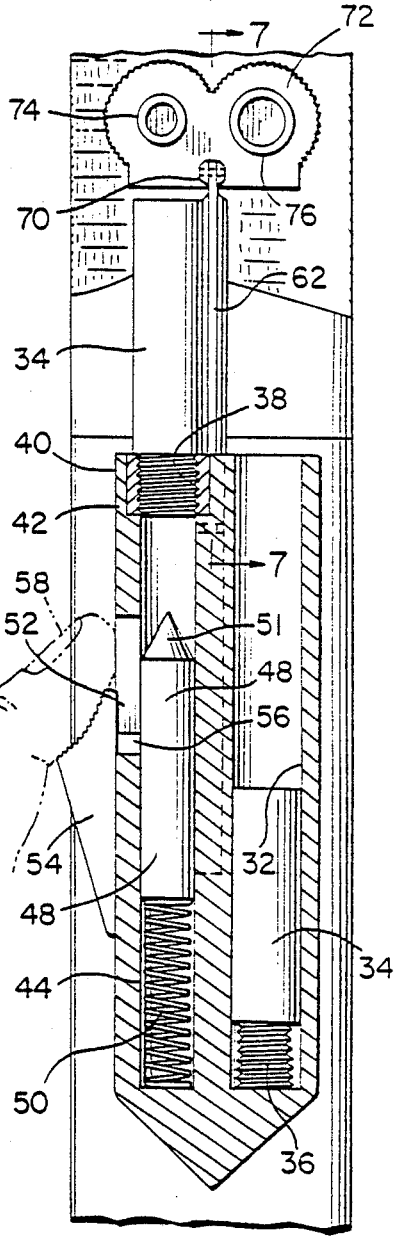
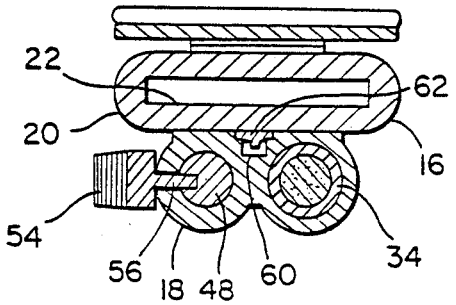
FIG. 6

SURVIVAL KNIFE SHEATH

BACKGROUND OF THE INVENTION

1 Field of the Invention

One of the most efficient solutions for determining the location of a person or persons who have become lost in wilderness or other danger zones is through the utilization of aerial flares, especially during the hours of darkness. Aerial flares are readily visible during the hours of darkness and are also visible to a high degree during the daylight hours. Further aerial flares are universally recognized as distress signals. Accordingly, a need exists for persons entering wilderness areas and other danger zones to equip themselves with readily transportable and actuatable aerial flares.

Aerial flares may be used not only by persons who have become lost, but also by persons who have become injured or otherwise have a need to attract attention to their specific locations.

Most aerial flares presently marketed are bulky and require additional mechanisms such as flare pistols and the like in which the flares may be fired. The bulkiness of the flares and flare firing equipment often deters the carrying of flares by persons who may well experience a situation in which the firing of aerial flares would be extremely beneficial.

Accordingly, a need exists for an improved form of aerial flare and aerial flare firing mechanism incorporated into equipment which is already substantially universally carried by all persons who enter wilderness areas and other danger zones. The instant invention incorporates an aerial flare storage compartment and aerial flare firing compartment within a sheath designed for use in conjunction with a survival knife. In this manner, a survival knife and sheath combination incorporating the instant invention may comprise the singlemost important piece of equipment carried by persons entering wilderness areas and other danger zones.

2. Description of Related Art

Various different forms of knife holders and sheaths heretofore have been provided as well as various different forms of flare launching devices.

Examples of these previously known structures are disclosed in U.S. Pat. Nos. 2,982,454, 3,385,163, 3,404,782, 3,576,278, 3,855,710 and 4,303,187.

However, these previously known structures do not combine knife holders and sheaths with flare holding structure and flare firing structure in a single piece of equipment such as a survival knife sheath, whereby the advantages of both a survival knife and signal flare storage and signal flare firing structure is incorporated in a single piece of equipment most universally carried by persons expecting to travel into wilderness areas or other danger zones.

SUMMARY OF THE INVENTION

The knife sheath of the instant invention is of a size, shape and construction to support an attendant survival knife. Survival knives may include numerous different features thereon for assisting a user in surviving while in remote areas. Accordingly, survival knives and supporting sheaths therefor are undoubtedly the most universally carried equipment by persons expecting to travel in wilderness areas and other danger zones.

The survival knife sheath of the instant invention, however, additionally incorporates therein a storage compartment for a plurality of aerial flares and also structure for supporting an aerial flare in firing position and firing the aerial flare.

The main object of this invention is to provide the most universally carried survival equipment with additional features whereby a plurality of aerial flares may be supported therefrom and the supported aerial flares may be fired through the utilization of aerial flare firing structure also incorporated in the equipment.

Another object of this invention is to provide a combined survival knife sheath, aerial flare storage and aerial flare firing structure of compact design and which will enable the carrier of the combined equipment to selectively fire aerial flares when desired.

Still another important object of this invention is to provide an aerial flare supporting and firing structure constructed in a manner whereby the aerial flare storage and firing facilities thereof may be sealed from the elements.

Still another important object of this invention is to provide a combined survival knife sheath, aerial flare storage and aerial flare firing assembly whose bulk and weight is only minimally more than the bulk and weight of a conventional survival knife sheath.

A final object of this invention to be specifically enumerated herein is to provide an apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the survival knife sheath of the instant invention removably supporting a survival knife therefrom and with the closure for the attendant aerial flare storage compartment and aerial flare firing compartment in a closed position;

FIG. 2 is an enlarged fragmentary view of the survival knife sheath with the survival knife removed and the cover for the aerial flare storage and firing compartments in the open position;

FIG. 3 is an enlarged side elevational view of the assemblage illustrated in FIG. 1 and with the survival knife handle fragmentarily illustrated in phantom lines;

FIG. 4 is a fragmentary vertical sectional view taken substantially upon the plane indicated by the section line 4—4 of FIG. 3, FIG. 5 is a fragmentary vertical sectional view similar to FIG. 4 but with the closure for the aerial flare storage compartment and aerial flare firing compartment in the open position, an aerial flare which has been removed from the storage compartment being illustrated as removably supported from the aerial flare firing compartment;

FIG. 6 is a horizontal sectional view taken substantially upon the plane indicated by the section line 6—6 of FIG. 4; and FIG. 7 is a fragmentary vertical sectional view taken substantially upon the plane indicated by the section line 7—7 of FIG. 5.

DESCRIPTION OF THE PREFERRED EMBODIMENT

Referring now more specifically to the drawings the numeral 10 generally designates a survival knife sheath from which a conventional form of survival knife referred to in general by the reference numeral 12 is removably supported, the handle 14 of the survival knife 12 projecting upwardly from the upper end of the sheath 10.

The sheath 10 defines an elongated upstanding body 16 having front and rear side portions 18 and 20. The rear side portion 20 defines an upwardly opening narrow compartment 22 in which the blade 24 of the survival knife 12 is telescopingly receivable. The lower end of the body 16 includes a cross head equipped fitting 26 projecting forwardly outwardly from the rear side portion 20 and a removable cap 28 is upwardly telescoped over the lower end of the body 16 and the fitting 26 for enclosing the latter, the cap 28 being tethered to the body 16 through a tether line structure 30. The fitting 26 may be used in conjunction with a metallic cutting edge (not shown) carried by the lower end of the body 16 and an oblong slot (not shown) in the free end portion of the blade 24 in order to removably pivotally mount the blade 24 from the body 16 with the cutting edge of the blade 24 in operative association with the aforementioned metallic cutting edge to cut wire and other pieces of metal.

The front side portion 18 of the body 16 defines a first upwardly opening compartment 32 for telescopingly receiving a pair of aerial flare shells 34 therein each equipped with a diametrically reduced and externally threaded base end portion 36 incorporating a center fire-type primer (not shown). The flare shells 34 are received within the compartment 32 in end aligned stacked relation.

A second compartment 38 also is defined within the front side portion 18 of the body 16 and comprises an internally threaded tubular fitting 40 seated within the upper end counterbore portion 42 of an upstanding bore 44 formed in the front side portion 18 and closed at its lower end as at 46. The bore 44 is slightly smaller in diameter than the interior diameter of the fitting 40 and comprises a compartment chamber disposed below and opening upwardly into the lower end of the compartment 38.

A cylindrical firing pin 48 is reciprocally received within the bore 44 and a compression spring 50 is disposed between the closed lower or bottom end 46 of the bore 44 and the lower end of the firing pin 48. Thus, the compression spring 50 yieldingly upwardly biases the firing pin 48 in the bore 44, the upper end of the firing pin 48 including a conical tip 51 which projects upwardly into the compartment 38 when the firing pin 48 is in the uppermost position thereof illustrated in FIG. 4.

One side of the forward side portion 18 includes a vertical longitudinal slot 52 formed therein and opening radially into the bore 44. The upper and lower ends of the slot 52 are closed and a finger engageable trigger member 54 is slidably disposed on the exterior of the slotted portion of the front side portion 18 of the body 16 and includes a shank portion 56 slidably received within the slot and having its innermost end anchored within a radially outwardly opening recess 58 formed in the side of the firing pin 48 registered with the slot 52. Accordingly, manual pressure may be applied in a downward direction by the user's thumb, see 58 in FIG. 5, to shift the firing pin 48 downwardly against the biasing action of the spring 50 to the lower limit position of the firing pin illustrated in FIG. 5. Thereafter, the thumb may be slipped out of engagement with the trigger member 54 in order to allow rapid upward displacement of the firing pin 48 by the compression spring 50.

With attention now invited more specifically to FIGS. 2, 4, 5, 6 and 7 of the drawings, the rear portion of the front side portion 18 includes an upwardly opening central cavity 60 in which a vertically reciprocal shank 62 is slidingly received. The lower end of the shank 62 includes an enlargement 64 thereon maintaining the shank 62 captive within the enlarged lower end portion 66 of the cavity 60 and the upper end of the shank 62 is pivotally attached as at 68 to the lower end of a support shank 70 for a closure cap 72. The closure cap 72 includes a depending small diameter annular fitting 74 snugly telescopingly receivable within the upper end of the compartment 38 and a larger diameter annular fitting 76 snugly downwardly receivable within the upper end of the compartment 32. The closure cap is illustrated in FIG. 4 in the fully closed position forming a weather-tight closure for the upper ends of the compartments 32 and 38 and in the open position in FIG. 2 with the shank 62 and support shank 70 supporting the closure cap 72 in an upwardly displaced position laterally offset to one pair of corresponding sides of the compartments 32 and 38.

When it is desired to fire an aerial flare shell, the closure cover 72 is moved from the closed position illustrated in FIG. 4 to the open position thereof illustrated in FIGS. 2, 5 and 7 and a flare shell 34 is removed from the chamber 32 and threaded into the chamber 38. Then, the trigger 54 is downwardly depressed by finger pressure and then released for rapid upward movement under the biasing action of the spring 50 for impact with the primer carried by the lower end of the shell 34 threaded in the chamber 38. Impact of the firing pin 48 with the primer will of course fire the flare shell 34. It is pointed out that the flare shell 34 is not fired within a barrel. Accordingly, the flare shell 34 includes a casing which is sufficiently strong to withstand the firing of the shell 34.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A survival knife sheath including a vertically elongated body having opposite upper and lower ends, one side of said body defining an upwardly opening knife blade receiving cavity, the other side of said body defining a pair of upwardly opening compartments, one of said compartments defining an aerial flare storage compartment and having at least one aerial flare removably received therein including an impact actuatable primer equipped base end and a flare assembly discharge end, the other of said compartments defining an aerial flare firing compartment and including means for receiving and releasably anchorably supporting at least the base end of said flare within said other compartment with said flare assembly discharge end facing upwardly, a firing pin slidably mounted from said body beneath said other compartment and for movement between a lower retracted position below said other compartment and an upper position projecting upwardly into said other compartment for impact engagement with said primer, biasing means yieldingly biasing said firing pin upwardly relative to said body toward said upper position, and manually engageable force transmission means operable from the exterior of said body to shift said firing pin from said upper position toward said lower position and thereafter releasable to allow said biasing means to bias said firing pin in an unrestricted manner upwardly toward said upper position and impact with the primer equipped base end of said aerial flare.

2. The knife sheath of claim 1 including cover means shiftably supported from said body for movement between a closed position closing the upper ends of said compartments and an out of the way open position enabling free access to the upper ends of said compartments through the upper ends thereof.

3. The knife sheath of claim 2 including means supporting said cover means from said sheath for guided movement between said closed and open positions and wherein said open position of said cover means is spaced above the open upper ends of said compartments and laterally spaced outwardly of corresponding sides of said compartments.

4. The knife sheath of claim 1 wherein said manually engageable force transmission means comprises a trigger member slidably mounted on the exterior of said body, said body including a firing pin bore formed therein immediately beneath said other compartment and in which said firing pin is slidably disposed, said body having a slot formed therein extending longitudinally of and opening radially inwardly of said bore, said trigger member including a shank portion supported therefrom, slidably received in said slot and anchored relative to said firing pin.

5. The knife sheath of claim 4 wherein said means yieldingly biasing said firing pin upwardly relative to said body includes a compression spring disposed in said bore beneath said firing pin.

6. The knife sheath of claim 1 wherein said means for receiving and releasably anchorably supporting at least the base end of said flare within said other compartment comprises internal threads formed in said other compartment and the base end of said flare is diametrically reduced, externally threaded and removably threadedly engaged in said other compartment.

7. The knife sheath of claim 6 wherein said manually engageable force transmission means comprises a trigger member slidably mounted on the exterior of said body, said body including a firing pin bore formed therein immediately beneath said other compartment and in which said firing pin is slidably disposed, said body having a slot formed therein extending longitudinally of and opening radially inwardly of said bore, said trigger member including a shank portion supported therefrom, slidably received in said slot and anchored relative to said firing pin.

8. The knife sheath of claim 7 wherein said means yieldingly biasing said firing pin upwardly relative to said body includes a compression spring disposed in said bore beneath said firing pin.

9. The knife sheath of claim 8 including cover means shiftably supported from said body for movement between a closed position closing the upper ends of said compartments and an out of the way open position enabling free access to the upper ends of said compartments through the upper ends thereof.

10. The knife sheath of claim 9 including means supporting said cover means from said sheath for guided movement between said closed and open positions and wherein said open position of said cover means is spaced above the open upper ends of said compartments and laterally spaced outwardly of corresponding sides of said compartments.

* * * * *